US009901159B2

(12) United States Patent
Kamm

(10) Patent No.: US 9,901,159 B2
(45) Date of Patent: Feb. 27, 2018

(54) WIRE CORE BRUSH WITH TWISTED FILM

(71) Applicant: GEKA GmbH, Bechhofen (DE)

(72) Inventor: Wolfgang Kamm, Arberg (DE)

(73) Assignee: GEKA GmbH, Bechhofen (DE)

( * ) Notice: Subject to any disclaimer, the term of this patent is extended or adjusted under 35 U.S.C. 154(b) by 12 days.

(21) Appl. No.: 14/384,109

(22) PCT Filed: Mar. 11, 2013

(86) PCT No.: PCT/EP2013/054908

§ 371 (c)(1),
(2) Date: Sep. 9, 2014

(87) PCT Pub. No.: WO2013/132109

PCT Pub. Date: Sep. 12, 2013

(65) Prior Publication Data

US 2015/0071695 A1 Mar. 12, 2015

(30) Foreign Application Priority Data

Mar. 9, 2012 (DE) ..... 20 2012 002 305 U

(51) Int. Cl.

| | |
|---|---|
| ***A45D 40/26*** | (2006.01) |
| ***A46B 3/18*** | (2006.01) |
| ***A46B 9/02*** | (2006.01) |
| ***A46D 3/00*** | (2006.01) |

(52) U.S. Cl.

CPC ..... *A45D 40/262* (2013.01); *A46B 3/18* (2013.01); *A46B 9/021* (2013.01); *A46D 3/00* (2013.01); *A46B 2200/106* (2013.01)

(58) Field of Classification Search

CPC ..... A45D 40/262; A46D 3/00; A46B 3/18; A46B 9/021; A46B 9/06; A46B 9/065

See application file for complete search history.

(56) References Cited

U.S. PATENT DOCUMENTS

| | | | | |
|---|---|---|---|---|
| 1,333,663 | A | 3/1920 | Kirby | |
| 6,295,994 | B1 | 10/2001 | Thayer et al. | |
| 7,254,860 | B2 | 8/2007 | Dumler et al. | |
| 8,505,553 | B2 * | 8/2013 | Vandromme | 132/218 |
| 8,578,948 | B2 * | 11/2013 | Bickford | A46B 9/021 132/317 |
| 8,662,090 | B2 | 3/2014 | Gueret | |
| 2008/0060669 | A1 | 3/2008 | Malvar et al. | |
| 2009/0320872 | A1 * | 12/2009 | Vandromme | 132/218 |
| 2012/0023691 | A1 * | 2/2012 | Prince | A46B 3/18 15/160 |

FOREIGN PATENT DOCUMENTS

| | | | |
|---|---|---|---|
| DE | 19847733 | A1 | 4/2000 |
| DE | 10211780 | A1 | 9/2003 |
| DE | 60022496 | T2 | 1/2006 |
| EP | 1938709 | A1 | 7/2008 |
| FR | 2891709 | A1 | 4/2007 |
| JP | 2010-069022 | | 4/2010 |

* cited by examiner

*Primary Examiner* — Rachel Steitz

(57) ABSTRACT

A wire core brush, preferably in the form of a cosmetic or mascara applicator, having bristle-forming elements held between at least two wires that are twisted together, forming bristles arranged essentially along at least one helix, between which a helical open space is provided, characterized in that the helical open space is partially filled by a film strip, which wraps around circumference surface shared by the wires that are twisted together.

16 Claims, 5 Drawing Sheets

WIRE CORE BRUSH WITH TWISTED FILM

FIELD OF THE INVENTION

The invention relates to a wire core brush.

BACKGROUND OF THE INVENTION

Wire core brushes in an extremely wide variety of embodiments have been part of the prior art for a long time.

Wire core brushes are produced in that a number of bristle-forming elements, usually in the form of filaments, i.e. fiber segments with a generally defined length, are inserted between at least two wires that are still parallel to each other at first. Then the wires are twisted together, as a result of which the filaments are clamped between the wires and permanently secured. Typically, each filament is secured approximately in the region of its middle between the wires that are twisted together, so that each filament forms two bristles that protrude outward from the wire core. Generally, the filaments are not clamped between the wires individually, each by itself, but rather in bunches. In other words, each bunch of filaments composes two bristle bunches.

Wire core brushes are used for a wide variety of purposes and are therefore also produced in a wide variety of sizes. Protection is claimed for all types and sizes of wire core brushes that use the invention explained below. Preferably, however, protection is claimed for cosmetic brushes and in particular for brushes for applying mascara compound to the lashes of the eyelid.

In the course of the twisting, the wires exert powerful forces on the bristle-forming elements; adjacent bristle-forming elements, in the region in which they are clamped between the wires, also exert forces on each other in a reciprocal fashion. The twisting therefore usually produces a bristle set which, with regard to the radially outer ends of the bristles, has its greatest bristle density along at least one helix; many bristles, however, nevertheless protrude with their ends into the region between two relatively closely adjacent sections of the helix or helixes. This results in a more or less intrinsically closed bristle set when viewed from the outside.

Such a bristle set does not inherently have at least essentially bristle-free interstices that are freely accessible from the outside (i.e. from the outer circumference of the bristle set) and are able to store an increased quantity of the substance to be applied and/or with which a kind of combing or separating action can be achieved.

This is a certain inherent disadvantage that wire core brushes have in comparison to single-component or multi-component injection-molded brushes that have seen widespread use in the last decade. This is because injection-molded bristles can be produced in rows with precisely defined spacings that can be freely selected in wide ranges so that already in the design of the brush, it is possible to precisely predetermine how large the store of compound in the interstice between two adjacent bristle rows should be. Furthermore, the size of the interstices can also be adjusted particularly well so that the lashes can be inserted largely unhindered into the interstices, which makes it possible in particular to set a more or less pronounced combing action.

In order to remedy this inherent disadvantage of brushes with a wire core composed of twisted wires, it has already been proposed to grind or trim the brush immediately after the twisting so that a part of the bristles is removed. This produces bristle-free zones within the bristle set, which then form a compound store and/or exhibit the desired combing action. Such an approach, however, requires an additional work step, which should be avoided for cost reasons.

Another proposal that can remedy this disadvantage is that at least in some regions, only a reduced number of bristle-forming elements or filaments are inserted between the wires that are to be twisted together in the next step. This reduces the pressure that the bristle-forming elements or filaments are subjected to in the region in which they are clamped between the wires during the twisting. The result is that they are deformed less powerfully and therefore have less of a tendency to stick out "crazily in all directions." This yields a bristle set that, with a corresponding reduction in the density of its bristle-forming elements, has a helical region that is bristle-free or at least essentially bristle-free. This interstice, however, is very narrow, and therefore does not improve the application properties enough.

In light of this situation, the object of the invention is to create a wire core applicator that can be efficiently produced and has improved compound-storing properties and/or an improved combing action.

SUMMARY OF THE INVENTION

According to the invention, a wire core brush is proposed, which has bristle-forming elements that are held between at least two wires, which are twisted together, and that form bristles that are arranged essentially along at least one helix and between the bristles, i.e. all of the bristles, a helical open space is provided. This helical open space is partially filled by a strip of film that is essentially wound around the outside of the wire core.

The term "a film strip" here, however, preferably does not absolutely imply "a one-piece" film strip. The film strip can also be composed of a plurality of strip parts that are arranged in parallel.

If the wires are each separately wrapped in film in a "hose-like" fashion, the film according to the invention must in any case be provided as well, because a film or plastic coating that already covers an individual wire before the twisting does not constitute a film as defined by the invention.

This film ensures that the helical open space is essentially freely accessible from the outside, i.e. not only is present in the region close to the roots of the bristles protruding from the wire core, but also extends in the radially outward direction through the bristle until it reaches the outside and therefore is also present in the region of the imaginary envelope curve that encloses the bristle set at its outer circumference (i.e. in the region of the radially outer ends of the bristles). If individual bristles, despite the presence and effect of the film, essentially deviate from their proper orientation because an incorrect orientation has been imparted to them in the course of the twisting and extend into the open space, this is harmless.

The term "bristle" is preferably understood here and below to mean a rod-shaped, intrinsically one-piece section of a fiber whose length in the direction of its longitudinal axis is considerably greater, preferably by at least a factor of 8, than its diameter or its average diameter. The average diameter here is understood to be the diameter of the circle whose area corresponds to the cross-sectional area of the rod-shaped fiber section. The term "bristle" is thus preferably understood in the conventional, narrow sense.

Ideally, the cross-section of the rod-shaped fiber section is circular or essentially round; the cross-section can, however, also have a polygonal shape if necessary, e.g. a hexagonal, octagonal, or decagonal shape, or can have a square or rectangular shape. The latter embodiment is tolerated, but not preferred since with cross-sectional shapes embodied in this way, it is difficult to guarantee that the bristles, even after the twisting, will not protrude crazily, or will only do so in a small number of cases, rather than being oriented essentially in the same direction.

In another sense of the invention that is relevant, but not technically preferred, the term "bristle" also includes loop-like elements, or elements that are bunch-like or branched into a plurality of strands, as well as fin-like elements, which all can taper from their root region to their radially outer end.

The above-mentioned object is also attained in an embodiment that includes a wire core brush with bristles that are held between at least two wires that are twisted together in which the bristles have the orientation and/or local bristle density that results from the fact that in addition to the bristle-forming elements that have been inserted between the wires before the twisting, a film or a piece of film has been inserted as well, after which the wires have been twisted together without first removing the film. The presence of such a piece of film during the twisting exerts an unexpected influence on the way in which the bristle-forming elements or filaments are distributed between the wires in the course of the twisting. Only a part of the piece of film is clamped between the wires, while the greater part of the piece of film winds around the circumference surface. Preferably, the piece of film is dimensioned so that the resulting film strip that winds around the outside of the wire core has the tendency to homogenize the orientation of the bristles. This is because the edges of the film strip in the region close to the roots act on the adjacent bristles with forces that are oriented predominantly in the direction of the longitudinal axis L of the wire core and thus have the tendency to force the bristles to be oriented more markedly in a direction orthogonal to the longitudinal axis of the wire core.

The above-mentioned object is also attained with the features of an embodiment that includes a wire core brush having bristles that are held between at least two wires that are helically twisted together in which the wire core forms an at least double-start thread that has at least one thread along which no bristle-forming elements are held between the wires so that they protrude outward from this thread and has at least one thread along which bristle-forming elements are held between the wires so that their ends protrude outward from this thread and form bristles.

Because at least one thread is not equipped with bristle-forming elements whose ends protrude outward from the thread as bristles, a large open space is produced between the bristles of two bristle-holding threads that are immediately adjacent to each other across the bristle-free thread. Even if an incorrect orientation is imparted to a number of bristles of each of the bristle groups in the course of the twisting and they protrude laterally into the region of the open space instead of protruding in an essentially radial direction, this approach nevertheless produces a broadened open space that is not effectively obstructed by the incorrectly oriented bristles. Consequently, such an open space constitutes a quite effective store of compound and/or an open space into which the eyelashes can be inserted.

One possibility for producing such a wire core brush lies in inserting not only a number of bristle-forming elements or filaments, but also a film or piece of film along with them before the wires are twisted and then twisting the wires together along with the filaments and the film. Protection is also claimed for this type of manufacture as such.

In this connection as well, the term "bristle" is defined as indicated at the beginning.

Preferably, the film, particularly when it is embodied as a plastic film, has a thickness of 0.008 mm to 0.08 mm. A film of this thickness is as a rule thick enough that it is not prematurely crushed between the wires as the wires are twisted, but instead is able for long enough to perform its task of influencing the way in which the bristle-forming elements or filaments are distributed between the wires. Ideally, the film has a thickness of 0.01 mm to 0.04 mm. A film of such a thickness influences not only the distribution of the bristle-forming elements between the wires that occurs in the course of the twisting, but it can also be used to simultaneously form a film strip in the course of the twisting that winds in spiral fashion around the outer surface of the wire core and positively influences the orientation of the bristles laterally adjacent to it.

Preferably, essentially rectangular film strips are used, which have a length of 10 mm to 50 mm and a breadth of 5 mm to 20 mm; before the twisting, the film strip is oriented so that this length is oriented essentially parallel to the longitudinal axes of the not yet twisted wires.

In order to equip the not yet twisted wires, preferably this film strip and the bristle set (i.e. the group of filaments that are still lying parallel and that will subsequently constitute the radially protruding bristles) are inserted together between the not yet twisted wires, with the bristles more or less lying on the flat film.

The film is advantageously matched to the diameter of the wire. In particular, films of the above-mentioned thicknesses are ideally used with wires that, each on their own, have a diameter of 0.4 mm to 0.9 mm before the twisting; wire diameters of up to 1.2 mm are less preferred, but absolutely possible. It is best to use wires that are not painted and not precoated with plastic.

Preferably, filaments are used as bristle-forming elements, whose diameter is likewise matched to the film and the wire, thus yielding a total film/wire/filament system. The diameter of the filaments used along with the above-mentioned film is preferably between 0.008 mm and 0.04 mm, ideally between 0.01 mm and 0.03 mm; not imperatively, but ideally, the filaments have a completely or at least essentially circular cross-section.

The film to be used according to the invention can in principle be a plastic film, a metal foil, or a woven or nonwoven fabric. The use of a plastic film is clearly preferable.

Based on the above, various preferred possible embodiments have turned out to be particularly well-suited in practice to implement the invention to maximum advantage:

The use of a film that swells under the influence of moisture is an attractive option. The film is twisted into the wires in the essentially unswollen state and subsequently swells under the influence of the moisture contained in the cosmetic compound to be applied. Its volume increases and thus exerts an essentially laterally acting pressure on the surrounding bristles, which forces them into a different orientation.

Another very attractive option is to use film/metal laminates or metallized films. Such films typically have a different stretching behavior and therefore have a different influence on the surrounding bristles and also, with their metallic shine, lend the associated applicator an unmistakable appearance, which can help in telling different applicators for different intended uses apart from one another.

The effect according to the invention can also be varied in an interesting way in that a so-called elastomer film is used for the film, i.e. a film composed of a material that is rubber-elastic, so to speak.

Finally, the use of a flocked film has turned out to be an interesting alternative because the flocking of such a film can be used to influence the compound storing behavior of the space between the bristles that is kept open by the film.

Ultimately, initial tests have shown that if necessary, even so-called gift ribbon—i.e. any of the flat, colorful ribbons that are used for packaging gifts and that can be curled by pulling them across the blade of a pair of scissors or a knife—can be used for the film as defined by the invention.

Despite these alternatives, however, the fact remains that the use of a plastic film is preferable.

Preferably, the film is a transparent or opaque film through which the wire core of the brush is visible. It is thus possible for the film to perform its task without being visually apparent and off-putting at first sight.

In a preferred exemplary embodiment, a plastic film that shrinks when subjected to heat is used. Surprisingly, it has turned out that heat-shrinkable films, because of the inherent orientation of their molecular chains—which ensures their heat shrinkability, have a toughness and/or stretching behavior that becomes positively apparent to an outstanding degree in the course of the twisting—even if the actual heat shrinkability of such a film is not usually used in the brush production.

Ideally, the films used are tough enough that they can be stretched by at least 80% and preferably by at least 150% of their initial length before they break. This ensures that (particularly with films that have a thickness of 0.01 mm to 0.04 mm) the relevant film, in the course of the twisting, winds to a substantially intimate degree around the shared outer circumference surface of the wires that are twisted together and thus constitute the wire core, thus exerting the desired action on the bristles adjacent to the film strip—the particularly intimate winding simultaneously prevents the penetration of cosmetic compound into the region between the film and the wire core, which is hygienically advantageous.

Preferably, the film is a PE film. PE offers the advantage that its tear strength and its stretching behavior are ideal for the use according to the invention, while PE simultaneously has a sufficient chemical resistance to the ingredients in current cosmetics.

In a preferred embodiment, the film is inserted as a film strip between the not yet twisted wires of the subsequent wire core, whose breadth (BFS) corresponds to at least 30% of the length (LFI) of a filament. Such a film strip, which is significantly narrower compared to the length of the filaments, influences the way in which the filaments are distributed between the wires in the course of the twisting without at the same time absolutely producing a clearly visible film strip, that winds around the outside of the wire core.

Ideally, the breadth (BFS) of the film strip, however, comprises at least 50% or better still, at least 75% of the length (LFI) of a filament. Such a film strip not only influences the distribution of the filaments in the course of the twisting, but at the same time also, as a clearly visible film strip, comes to lie around the outer circumference surface of the wire core produced by the twisting, which positively influences the orientation of the bristles protruding outward from the wire core.

The length of the film strip in the direction of the longitudinal axis of the subsequent wire core can vary. Preferably, the length of the film is only a fraction of the total bristle set length of the wire core brush, ideally at least 25% and better still, approx. 50% of the total bristle set length. This gives the brush a bristle set that varies in the longitudinal direction, which can be used in a very versatile way because according to the invention, in some regions between those that are equipped with bristles, it has distinct open spaces which can store compound or can be used for combing, while in at least one other region of the bristle set, it is much more densely equipped with bristles or even has a bristle set that is, essentially speaking, intrinsically closed at the outer circumference surface, which has a significantly different application behavior. This permits the user to vary.

The wire core brush according to the invention is characterized in that just before the twisting of the wires, the following layering must be constructed: wire, optional film (can be omitted if need be), layer composed of bristle-forming elements or filaments oriented essentially parallel to one another, film, and wire. In this connection, the at least one film and the bristle-forming elements or filaments are supplied together, preferably so that the filaments, etc. rest on the film.

BRIEF DESCRIPTION OF THE DRAWINGS

Other advantages, possible embodiments, and functions of the invention will become apparent from the description of an exemplary embodiment of the invention with the aid of the figures. In the drawings.

DETAILED DESCRIPTION OF THE PREFERRED EMBODIMENTS

Figure 1:
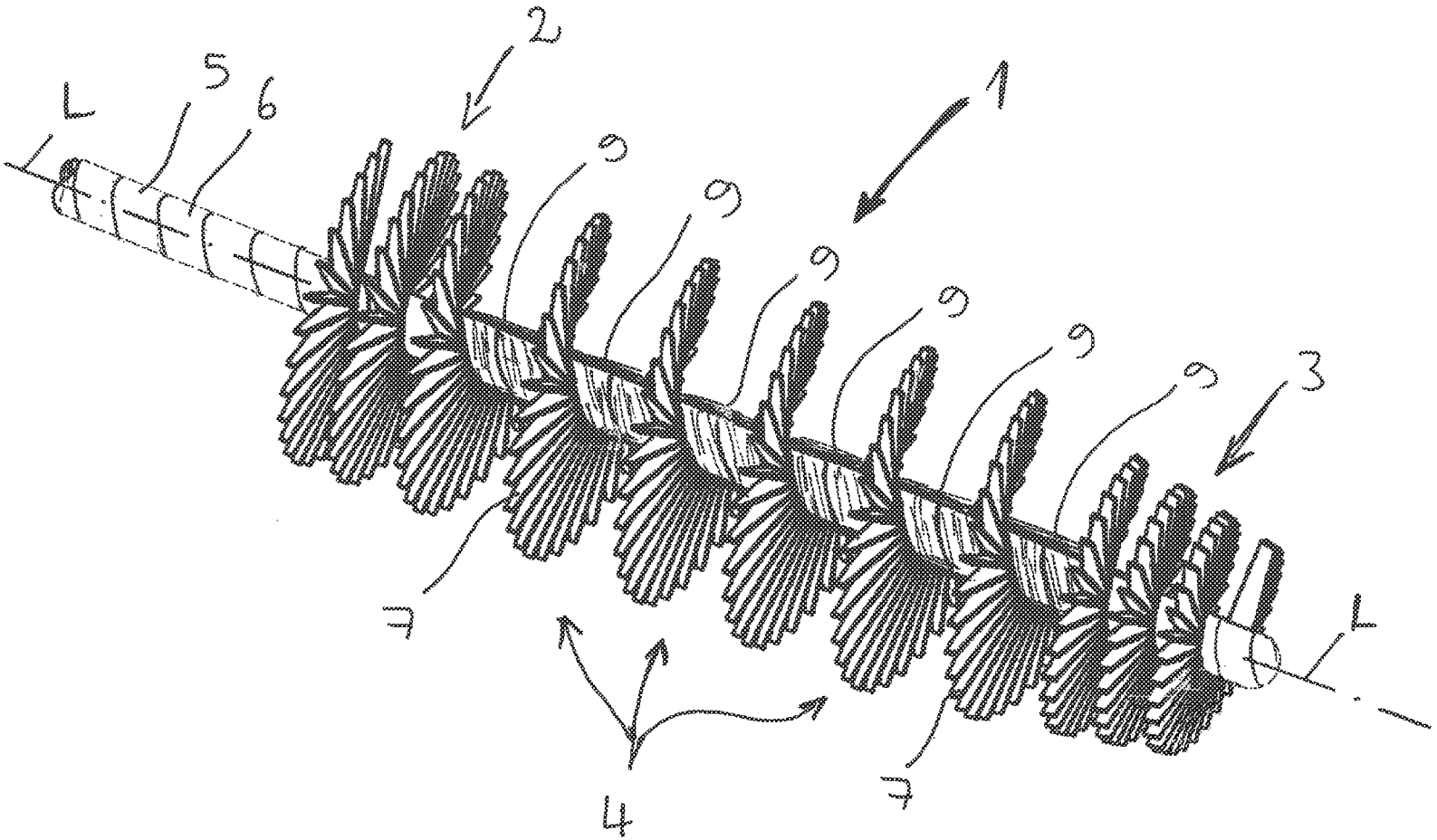
FIG. 1 shows a perspective view of an exemplary embodiment in an inclined view from above.

FIG. 1 gives a first overview of the exemplary embodiment according to the invention, which in this case is embodied in the form of a mascara brush. The brush here is shown at a significantly enlarged scale. In actuality, in mascara brushes of this kind, the bristle set has a length of between 17.5 and 35 mm and a maximum outer diameter of 7.5 to 15 mm, measured in the direction along the twisting axis of the wire core.

At its proximal end, i.e. close to the handle, the applicator 1 has a first closely spaced bristle set region 2, i.e. a bristle set region in which the bristle density is higher than in another bristle set region, preferably the middle bristle set region. In the region of its tip, i.e. in the region of its distal end, it preferably has a second closely spaced bristle set region 3. In its middle region, which makes up the preponderance of the length of the applicator in the direction of the longitudinal axis L, the bristle set is lighter and has the interstices according to the invention so that in this region, one can speak of the existence of a bristle set 4 that is less densely packed in comparison to the bristle set regions 2 and 3.

The applicator 1 shown here as a first exemplary embodiment has a wire core composed of two wires 5 and 6 that are twisted together. Between these wires are clamped bristle-forming elements, approximately in the region of their middles. Preferably, filaments are used, which form a bristle group that extends along at least one helix. The individual bristles of the bristle group are not shown in detail in the figures; instead, each of the elements shown with a fin-like embodiment represents a number of individual bristles—a bristle bunch, so to speak.

In reality, each individual filament produces two bristles, which protrude outward approximately in the radial direction in relation to the longitudinal axis L. The bristles vaguely indicated by the elements shown with a fin-like embodiment are labeled with the reference numeral 7. According to the invention, the term "bristle" is preferably understood to mean a rod-shaped structure. In one general aspect of the invention, however, bristles can also be embodied in another way, e.g. in the form of loops or structures that branch out as they extend from the inside toward the outside so that a bristle can be a structure that divides into a plurality of strands from the inside to the outside. Preferably, however, the term "bristle" is actually understood to be a classic bristle in the sense defined at the beginning.

In the first narrow bristle set region 2 and in the second narrow bristle set region 3, no special measures have been taken. Instead, the filaments here have been inserted between the wires 5 and 6 in an intrinsically known way before the wires are twisted to form a wire core. Because of this, they constitute a bristle field of the known type whose density is the greatest along a helix and from which individual bristles, however, protrude into the interstice between two helixes or at least the helixes are arranged so closely in succession that they result in a bristle set that appears to be almost intrinsically closed when viewed from the outside.

The measures according to the invention affect the bristle set region 4. Here, the bristles are arranged along a helix so that between the individual sections of the helix, an interstice remains that is clear and bristle-free to the greatest extent possible. What is conspicuous here is that the bristles in this region are only arranged along one helix or one thread of the double-start thread formed by two twisted wires, while the second thread remains free of bristles.

It is also conspicuous that in the largely bristle-free region, a film strip 9 has been wound around the outside of the wire core produced by the wires 5 and 6. This does not mean that no film is to be found between the two wires 5 and 6 of the wire core. The larger part of the film, however, is wound around the outside of the wire core composed of the wires 5 and 6; only the smaller part of the film or film strip is clamped between the wires 5 and 6, but this is not visible in the figures. This film strip wound around the outside of the wire core preferably has the effect that it acts on the adjacent bristle bunches, which extend along a helix, with forces that are oriented essentially or predominantly in the direction of the longitudinal axis L and thus compress the individual bristle bunches, i.e. have the tendency to prevent the bristles from bending toward the open interstices and protruding into them.

The bristle set thus produced, with an arrangement of the bristles along a helix and large, essentially bristle-free interstices between them positively influences the make-up application result. On the one hand, the interstices can be easily filled with an increased quantity of mascara compound so that with a single dip and subsequent removal of the mascara applicator, a significant quantity of mascara can be applied to the lashes. On the other hand, the lashes can be inserted into the interstices between the bristle bunches arranged along a helix, thus making it possible to produce a good combing action.

Figure 2:
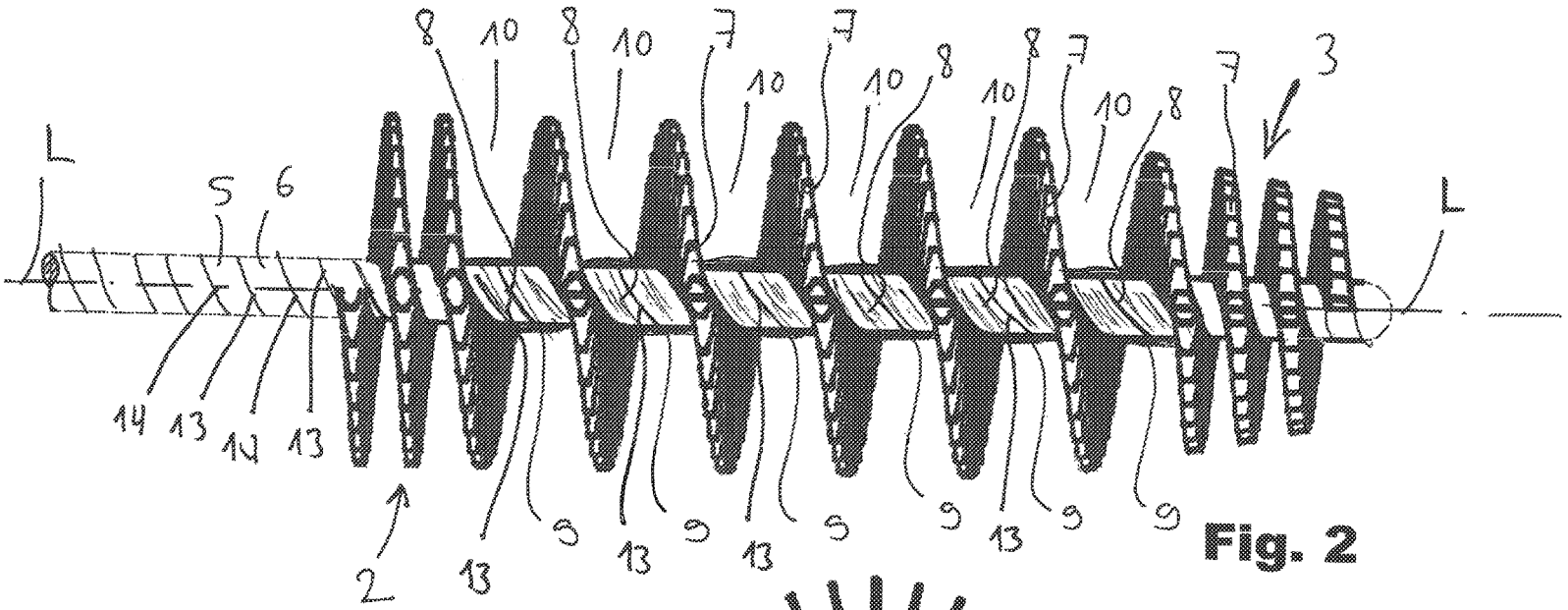
FIG. 2 shows a side view of an exemplary embodiment of the invention.

FIG. 2 shows the whole thing again in a side view.

Here, too, the first and second wire 5 and 6 are visible, which together form a twisted wire core. This drawing also once again shows the first bristle set region 2 that is provided with closely spaced bristles and that is situated at the end of the applicator close to the handle and the second bristle set region 3 that is likewise provided with closely spaced bristles, situated at the end of the applicator oriented away from the handle. Between them is the bristle set region 4 according to the invention, with completely or at least essentially bristle-free interstices 10 that are significantly larger than the interstices that remain between the rows of bristles of the first bristle set region 2 that is provided with closely spaced bristles and the second bristle set region 3 that is provided with closely spaced bristles. Contrary to what one might assume from the depiction that has been kept schematic with regard to the bristles in FIG. 2, the interstices between the bristle bunches of the closely spaced bristle regions 2 and 3 are in practice not completely free of bristles, but are instead as a rule obstructed by a not entirely insignificant number of bristles that, in the course of the twisting, have been subjected to a powerful lateral displacement and now protrude at an angle into the open space so that it is not easy for lashes to be inserted into the quite narrow and not quite entirely bristle-free interstices.

FIG. 2 also shows the film strip 9 that winds around the outside of the wire core composed of the first wire 5 and the second wire 6, even if a part of the film is clamped between the two wires 5 and 6. Here, too, it is clear that one of the two helixes formed by the two wires 5 and 6 that are twisted together (namely the helix 8) remains free of bristles, thus producing the particularly large interstice in the region 4.

Figure 3:
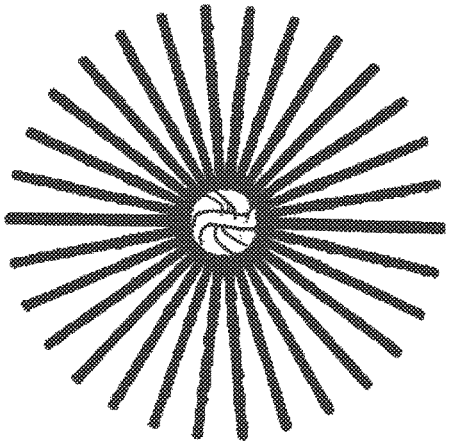
FIG. 3 shows an end view of the exemplary embodiment of the invention from the front.

FIG. 3 shows the brush from FIG. 2 in a head-on view from the front. As is clear from the drawing, there is a bristle set that is intrinsically closed in the circumference direction. In other words, the brush is equipped with bristles all the way around it.

Figure 4:
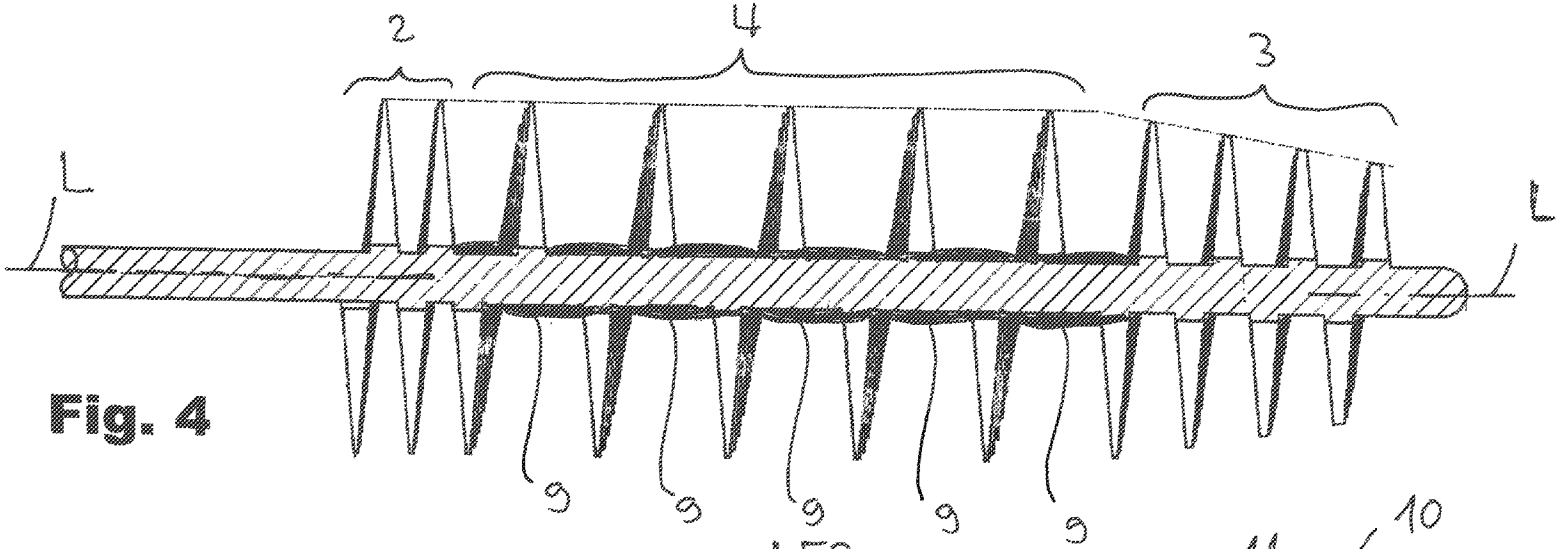
FIG. 4 shows a section through the exemplary embodiment shown in FIG. 2, extending along the center line or the longitudinal axis L of the wire core.

Upon consideration of FIG. 4, which shows a middle section, it becomes clearer how the exemplary embodiment is designed. Here, the film strip is shown clearly as a dark material concentration on the outer circumference of the twisted core, and quite clearly wraps largely around the outside of the wire core formed by the first wire and the second wire 6.

Figure 5:
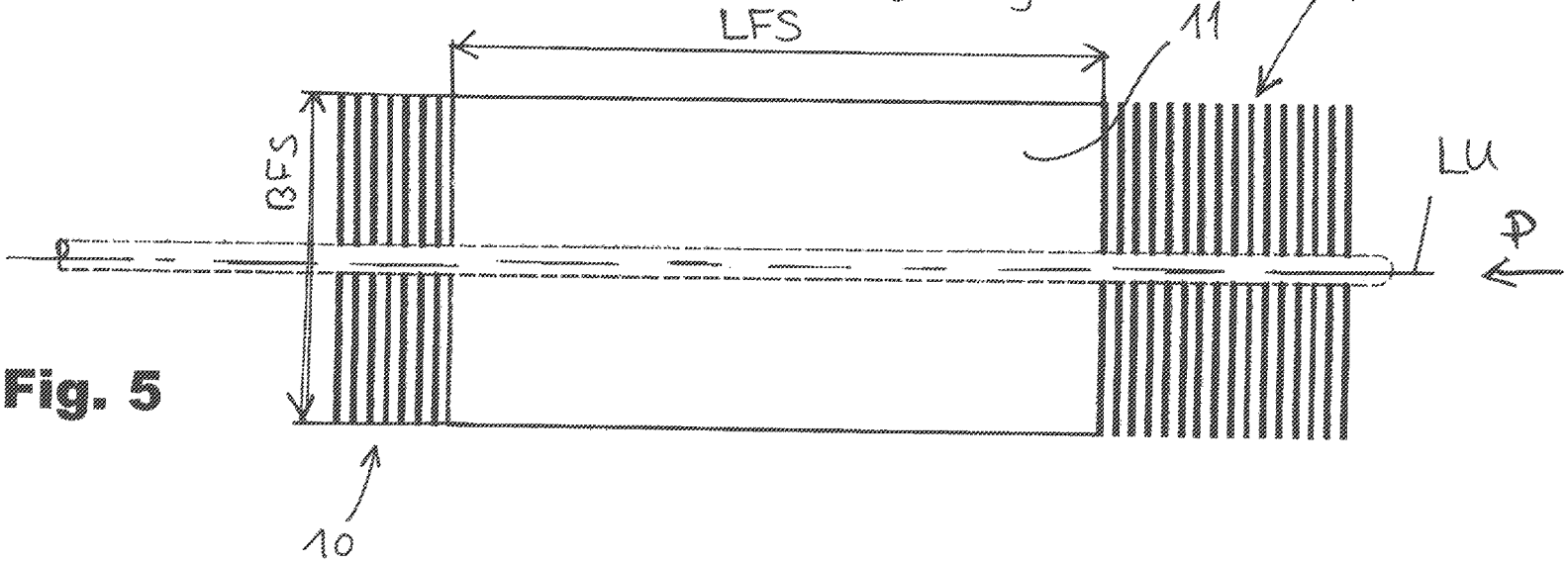
FIG. 5 shows the manufacture of the exemplary embodiment shown in the preceding figures at the moment in which the wires that subsequently constitute the wire core have not yet been twisted and between these two wires still extending parallel, the filaments and the film to be used according to the invention have been inserted; the twisting occurs in the very next step.

FIG. 5 shows how the brush according to the invention is manufactured. Over the entire length of the region 4 in which in the finished state, the bristle set should have the interstices according to the invention, a filament layer 10 of the filaments that will later constitute the bristles is inserted between the two not yet twisted wires, of which only the first wire 5 is visible here. Together with this, a film is inserted between the two wires 5 and 6. This film is a film strip whose length LFS essentially corresponds to the length of the region in which the bristles are to subsequently have the spacing according to the invention. The breadth of the film strip BFS here essentially corresponds to the length of the individual filament, i.e. the length of the filament perpendicular to the longitudinal axis LU of each untwisted wire 5 or 6 of the subsequent wire core.

No film is inserted into the region that will later form the first closely spaced bristle set region 2 or the second closely spaced bristle set region 3.

In the exemplary embodiment shown in FIG. 5, therefore, one of the two not yet twisted wires is immediately adjacent to the filament layer while the other of the two not yet twisted wires is immediately adjacent to the film.

The crucial point is that the film influences how the filaments that subsequently constitute the bristles are distributed between the two wires 5 and 6 when they are twisted. The presence of the film during the twisting causes the filaments in the places where the film is present to be distributed only along one of the two threads of the double-start thread formed by the two wires as a result of the twisting. In this way, one of the two bristle threads formed by the twisting, in the region in which the film is inserted, remains filament-free or bristle-free as explained above.

Figure 6:
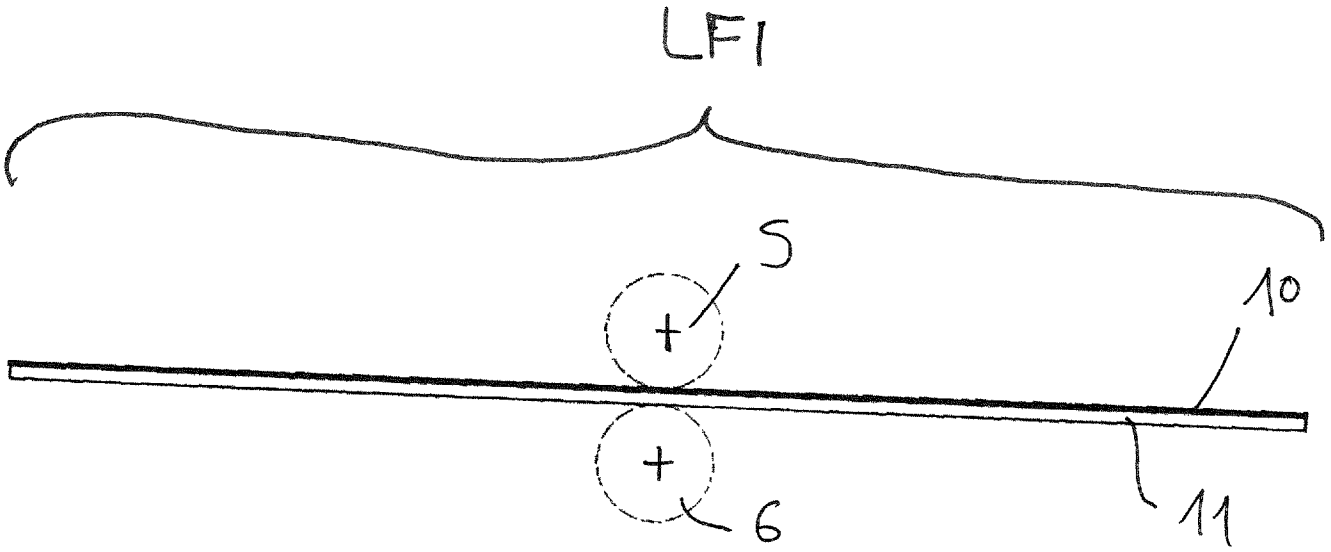
FIG. 6 shows the same thing as FIG. 5, but seen from the front.
Figure 7:
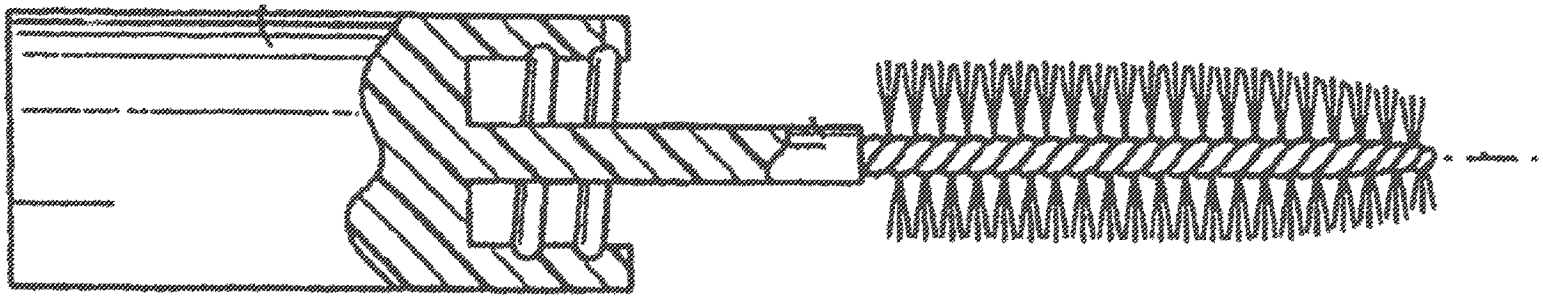
Fig. 7 Prior Art
FIG. 7 shows the prior art.

This manufacturing process is also shown again in FIG. 6, which shows a view of FIG. 5 in the direction of the arrow P. This figure shows very clearly the layer of filaments, which is labeled with the reference numeral 10 (filament layer) and the film, which in the not yet twisted state is labeled with the reference numeral 11, while the first wire and the second wire are labeled as usual with the reference numerals 5 and 6.

For the sake of completeness, certain embodiments include the following method: A method for manufacturing a wire core brush having bristle-forming elements held between at least two wires 5, 6 that are twisted together, characterized in that before the twisting, not only the bristle-forming elements, preferably in the form of filaments 10, but also a film 11 are inserted between the wires, after which the wires 5, 6 are twisted together, without having first removed the film 11. This method can be combined with all of the features or individual features of this application.

The invention claimed is:

1. A cosmetic or mascara applicator, comprising:

a bristle-free handle extending from a proximal end of the applicator; and a bristle set region located at the proximal end of the applicator, wherein the bristle set region includes a plurality of bristle-forming elements held between at least two wires that are twisted together, forming bristles, wherein the cosmetic or mascara applicator has been manufactured so that before twisting, the plurality of bristle-forming elements and a flat, rectangular piece of film have been inserted between the at least two wires with the film strip oriented so that its length is essentially parallel to a longitudinal axis of the at least two wires, after which the wires have been twisted together without first removing the piece of film, and wherein the film and the bristle-forming elements are independent of each other and the length of the film is greater than its breadth, and the film has a thickness of 0.008 mm to 0.08 mm.

2. The cosmetic or mascara applicator according to claim 1, wherein the film and the bristle set are inserted together between the not yet twisted wires, and the bristles rest on the film.

3. The cosmetic or mascara applicator according to claim 1, wherein the plurality of bristle-forming elements held between the at least two wires are twisted together, forming bristles arranged essentially along at least one helix, between which a helical open space is provided and the helical open space is partially filled by the piece of film, which wraps around a circumference surface shared by the wires that are twisted together.

4. The cosmetic or mascara applicator according to claim 1, wherein the film is a transparent or opaque film.

5. The cosmetic or mascara applicator according to claim 1, wherein the film shrinks when subjected to heat.

6. The cosmetic or mascara applicator according to claim 1, wherein the film is tough enough that it can be stretched by at least 80% of its initial length before it breaks.

7. The cosmetic or mascara applicator according to claim 1, wherein the film is a PE film.

8. The cosmetic or mascara applicator according to claim 1, wherein the film is inserted as a film strip between the not yet twisted wires of the subsequent wire core and the film has a breadth (BFS) that is at least 30% of a length (LFI) of a filament that subsequently, immediately after the twisting, forms two bristles protruding out from the wire core.

9. The cosmetic or mascara applicator according to claim 1, wherein the bristle-forming elements are filaments.

10. The cosmetic or mascara applicator according to claim 1, wherein a diameter of the bristle-forming elements is between 0.008 mm and 0.04 mm, and the bristle-forming elements have a circular cross-section.

11. The cosmetic or mascara applicator according to claim 1, wherein the film is inserted as a film strip between the not yet twisted wires of the subsequent wire core and the film has a length (LFS) that is at least 25% of a length (LB) along which the wire core of the finished brush is equipped with bristles.

12. The cosmetic or mascara applicator according to claim 1, wherein just before the twisting of the wires, the cosmetic or mascara applicator has the following layering: wire, film, layer comprising a plurality of bristle-forming elements oriented essentially parallel to one another, film, and wire.

13. The cosmetic or mascara applicator according to claim 1, wherein the film is a flocked film.

14. The cosmetic or mascara applicator according to claim 1, further comprising a mascara container containing, mascara in combination with the cosmetic or mascara applicator, wherein the cosmetic or mascara applicator may be dipped into and removed from the mascara container in order to apply mascara to the cosmetic or mascara applicator.

15. A method for manufacturing a cosmetic or mascara applicator having bristle-forming elements held between at least two wires that are twisted together, comprising:

inserting a plurality of bristle-forming elements in the form of filaments and a flat, rectangular piece of film between two wires with the film oriented so that its length is essentially parallel to a longitudinal axis of the two wires, and subsequently twisting the wires together without first removing the piece of film, wherein the film and the bristle-forming elements are independent of each other, and wherein the length of the film is greater than its breadth and the film has a thickness of 0.008 mm to 0.08 mm; and attaching the twisted wires to a bristle-free handle.

16. The method according to claim 15, comprising inserting the film and the bristle-loaning elements at the same time.

* * * * *